US011715891B2

(12) United States Patent
Chang et al.

(10) Patent No.: US 11,715,891 B2
(45) Date of Patent: Aug. 1, 2023

(54) COMMUNICATION DEVICE

(71) Applicant: Wistron NeWeb Corp., Hsinchu (TW)

(72) Inventors: Po-Yuan Chang, Hsinchu (TW); Chung-Yen Hsiao, Hsinchu (TW); Huang-Tse Peng, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 0 days.

(21) Appl. No.: 17/583,295

(22) Filed: Jan. 25, 2022

(65) Prior Publication Data

US 2023/0208053 A1 Jun. 29, 2023

(30) Foreign Application Priority Data

Dec. 24, 2021 (TW) ..... 110148624

(51) Int. Cl.
*H01Q 21/30* (2006.01)
*H01Q 21/28* (2006.01)

(52) U.S. Cl.
CPC ..... *H01Q 21/30* (2013.01); *H01Q 21/28* (2013.01)

(58) Field of Classification Search
CPC ..... H01Q 21/28; H01Q 21/30
See application file for complete search history.

(56) References Cited

U.S. PATENT DOCUMENTS

| | | | |
|---|---|---|---|
| 10,530,055 B2 | 1/2020 | Tsai | |
| 11,424,539 B2 | 8/2022 | Alpman et al. | |
| 2020/0127688 A1* | 4/2020 | Gopalakrishnan | H01Q 21/29 |

FOREIGN PATENT DOCUMENTS

| | | |
|---|---|---|
| TW | 201838352 A | 10/2018 |
| TW | 201924241 A | 6/2019 |

* cited by examiner

*Primary Examiner* — Graham P Smith
(74) *Attorney, Agent, or Firm* — McClure, Qualey & Rodack, LLP

(57) ABSTRACT

A communication device includes a first antenna element, a second antenna element, a third antenna element, a fourth antenna element, a fifth antenna element, a sixth antenna element, a seventh antenna element, an eighth antenna element, and a PCB (Printed Circuit Board). The PCB has a first side and a second side positioned opposite to each other. At least one of the first antenna element, the second antenna element, the third antenna element, the fourth antenna element, the fifth antenna element, the sixth antenna element, the seventh antenna element, and the eighth antenna element is adjacent to the first side of the PCB. The other(s) of the first antenna element, the second antenna element, the third antenna element, the fourth antenna element, the fifth antenna element, the sixth antenna element, the seventh antenna element, and the eighth antenna element is/are adjacent to the second side of the PCB.

17 Claims, 9 Drawing Sheets

COMMUNICATION DEVICE

CROSS REFERENCE TO RELATED APPLICATIONS

100011 This application claims priority of Taiwan Patent Application No. 110148624 filed on Dec. 24, 2021, the entirety of which is incorporated by reference herein.

BACKGROUND OF THE INVENTION

Field of the Invention

The disclosure generally relates to a communication device, and more particularly, to an almost omnidirectional communication device.

Description of the Related Art

With the advancements being made in mobile communication technology, mobile devices such as portable computers, mobile phones, multimedia players, and other hybrid functional portable electronic devices have become more common. To satisfy consumer demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi systems and using frequency bands of 2.4 GHz, 5.2 GHz, and 5.8 GHz.

Wireless access points are indispensable elements for mobile devices in a room to connect to the Internet at a high speed. However, since an indoor environment can experience serious signal reflection and multipath fading, wireless access points should process signals from a variety of transmission directions simultaneously. Accordingly, it has become a critical challenge for current designers to design a small-size and omnidirectional antenna system in the limited space of a wireless access point.

BRIEF SUMMARY OF THE INVENTION

In an exemplary embodiment, the invention is directed to a communication device that includes a first antenna element, a second antenna element, a third antenna element, a fourth antenna element, a fifth antenna element, a sixth antenna element, a seventh antenna element, an eighth antenna element, and a PCB (Printed Circuit Board). The PCB has a first side and a second side which are opposite to each other. At least one of the first antenna element, the second antenna element, the third antenna element, the fourth antenna element, the fifth antenna element, the sixth antenna element, the seventh antenna element, and the eighth antenna element is adjacent to the first side of the PCB. The other(s) of the first antenna element, the second antenna element, the third antenna element, the fourth antenna element, the fifth antenna element, the sixth antenna element, the seventh antenna element, and the eighth antenna element is/are adjacent to the second side of the PCB.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
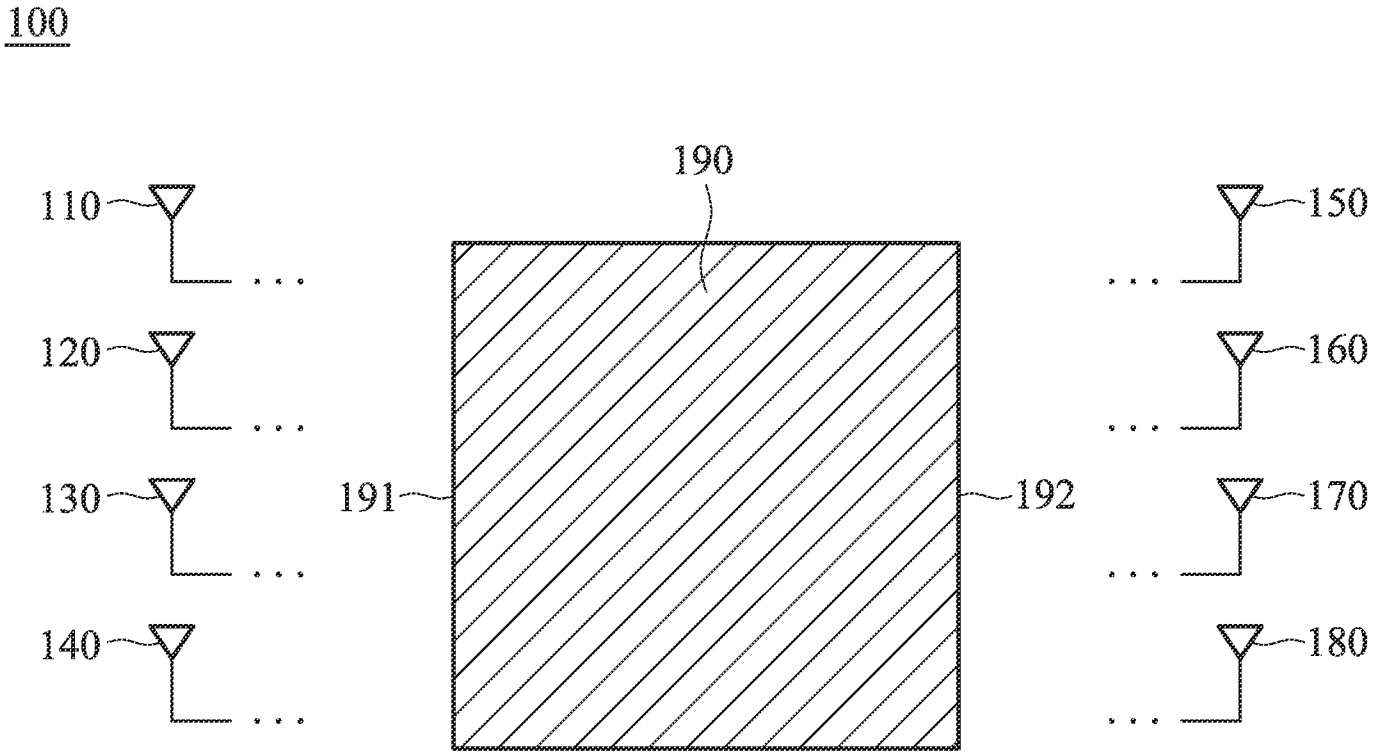
FIG. 1 is a diagram of a communication device according to an embodiment of the invention.

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Furthermore, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

FIG. 1 is a diagram of a communication device 100 according to an embodiment of the invention. For example, the communication device 100 may be applied to a wireless access point, but it is not limited thereto. In the embodiment of FIG. 1, the communication device 100 includes a first antenna element 110, a second antenna element 120, a third antenna element 130, a fourth antenna element 140, a fifth antenna element 150, a sixth antenna element 160, a seventh antenna element 170, an eighth antenna element 180, and a PCB (Printed Circuit Board) 190. The first antenna element 110, the second antenna element 120, the third antenna element 130, the fourth antenna element 140, the fifth antenna element 150, the sixth antenna element 160, the seventh antenna element 170, and the eighth antenna element 180 may all be made of metal materials, such as copper, silver, aluminum, iron, or their alloys. It should be understood that the communication device 100 may further include other components, such as a processor, a touch control module, a speaker, a power supply module, and/or a housing, although they are not displayed in FIG. 1.

The shapes and types of the first antenna element 110, the second antenna element 120, the third antenna element 130, the fourth antenna element 140, the fifth antenna element 150, the sixth antenna element 160, the seventh antenna element 170, and the eighth antenna element 180 are not limited in the invention. In some embodiments, each of the first antenna element 110, the second antenna element 120, the third antenna element 130, the fourth antenna element 140, the fifth antenna element 150, the sixth antenna element 160, the seventh antenna element 170, and the eighth antenna element 180 is a dipole antenna. In alternative embodiments, each of the first antenna element 110, the second antenna element 120, the third antenna element 130, the fourth antenna element 140, the fifth antenna element 150, the sixth antenna element 160, the seventh antenna element 170, and the eighth antenna element 180 is a PIFA (Planar Inverted F Antenna). In other embodiments, each of the first antenna element 110, the second antenna element 120, the third antenna element 130, the fourth antenna element 140, the fifth antenna element 150, the sixth antenna element 160, the seventh antenna element 170, and the eighth antenna element 180 is any type of antenna without using a system ground plane.

The PCB 190 has a first side 191 and a second side 192 which are opposite to each other. At least one of the first antenna element 110, the second antenna element 120, the third antenna element 130, the fourth antenna element 140, the fifth antenna element 150, the sixth antenna element 160, the seventh antenna element 170, and the eighth antenna element 180 is adjacent to the first side 191 of the PCB 190. On the other hand, the other(s) of the first antenna element 110, the second antenna element 120, the third antenna element 130, the fourth antenna element 140, the fifth antenna element 150, the sixth antenna element 160, the seventh antenna element 170, and the eighth antenna element 180 is/are adjacent to the second side 192 of the PCB 190. It should be noted that the term "adjacent" or "close" throughout the disclosure means that the distance (in the spacing) between two corresponding elements is shorter than a predetermined distance (e.g., 60 mm or the shorter), but often this does not mean that the two corresponding elements touch each other directly (i.e., the aforementioned distance/space between them is reduced to 0). In such a design, since the PCB 190 at least partially separates the aforementioned antenna elements, the isolation between these antenna elements is significantly increased. In addition, because the aforementioned antenna elements are arranged to substantially surround the PCB 190, the communication device 100 can provide an almost omnidirectional radiation pattern.

The following embodiments will introduce different configurations and detailed structural features of the communication device 100. It should be understood that these figures and descriptions are merely exemplary, rather than limitations of the invention.

Figure 2:
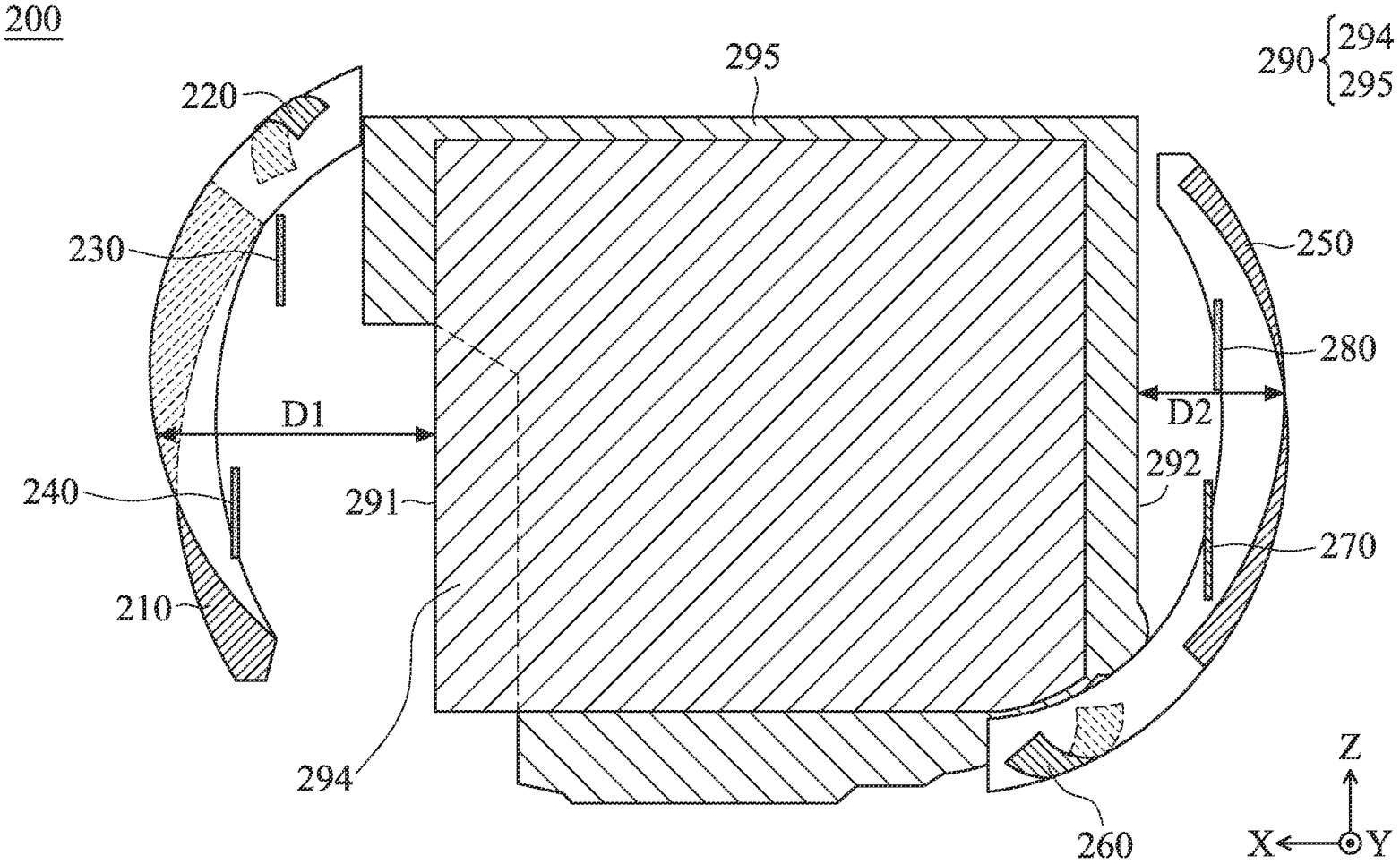
FIG. 2 is a front view of a communication device according to an embodiment of the invention.

FIG. 2 is a front view of a communication device 200 according to an embodiment of the invention. FIG. 2 is similar to FIG. 1. In the embodiment of FIG. 2, the communication device 200 includes a first antenna element 210, a second antenna element 220, a third antenna element 230, a fourth antenna element 240, a fifth antenna element 250, a sixth antenna element 260, a seventh antenna element 270, an eighth antenna element 280, and a PCB 290.

The PCB 290 has a first side 291 and a second side 292 which are opposite to each other, and includes a first layer board 294 and a second layer board 295 which are parallel to each other. For example, the first layer board 294 may substantially have a square shape, and the area of the second layer board 295 may be slightly larger than the area of the first layer board 294. In some embodiments, the communication device 200 further includes an arc-shaped nonconductive housing (not shown). The PCB 290 may be disposed inside the hollow portion of the arc-shaped nonconductive housing. The first antenna element 210, the second antenna element 220, the third antenna element 230, the fourth antenna element 240, the fifth antenna element 250, the sixth antenna element 260, the seventh antenna element 270, and the eighth antenna element 280 may all be fixed on the arc-shaped nonconductive housing. However, the invention is not limited thereto. In alternative embodiments, the aforementioned nonconductive housing may be a cube, a cuboid, or a triangular cylinder. In other embodiments, the first antenna element 210, the second antenna element 220, the third antenna element 230, the fourth antenna element 240, the fifth antenna element 250, the sixth antenna element 260, the seventh antenna element 270, and the eighth antenna element 280 are disposed on a plurality of antenna holders, respectively. These antenna holders may be respectively disposed at two sides of an internal base. The PCB 290 may be disposed at the center of the internal base. The internal base may be disposed inside the aforementioned arc-shaped nonconductive housing.

The first antenna element 210, the second antenna element 220, the third antenna element 230, and the fourth antenna element 240 are all adjacent to the first side 291 of the PCB 290. The fifth antenna element 250, the sixth antenna element 260, the seventh antenna element 270, and the eighth antenna element 280 are all adjacent to the second side 292 of the PCB 290. In some embodiments, the second antenna element 220 is adjacent to the first antenna element 210, and the third antenna element 230 and the fourth antenna element 240 are both disposed between the first antenna element 210 and the first side 291 of the PCB 290. In alternative embodiments, at least one of the third antenna element 230 and the fourth antenna element 240 is positioned between the first antenna element 210 and the first side 291 of the PCB 290. In some embodiments, the sixth antenna element 260 is adjacent to the fifth antenna element 250, and the seventh antenna element 270 and the eighth antenna element 280 are both disposed between the fifth antenna element 250 and the second side 292 of the PCB 290.

In some embodiments, the communication device 200 covers a first frequency band FB1, a second frequency band FB2, and a third frequency band FB3. For example, the first frequency band FB1 may be from 617 MHz to 960 MHz, the second frequency band FB2 may be from 1710 MHz to 2700 MHz, and the third frequency band FB3 may be from 3300 MHz to 5925 MHz. Accordingly, the communication device 200 can support at least the wideband operations of the conventional LTE (Long Term Evolution) and the next 5G (5th Generation Mobile Networks) communication. With respect to the antenna theory, the first antenna element 210 and the fifth antenna element 250 are excited to generate the first frequency band FB1, the second frequency band FB2, and the third frequency band FB3. The second antenna element 220, the sixth antenna element 260, and the seventh antenna element 270 are excited to generate the second frequency band FB2 and the third frequency band FB3. In addition, the third antenna element 230, the fourth antenna element 240, and the eighth antenna element 280 are excited to generate the third frequency band FB3. Other features of the communication device 200 of FIG. 2 are similar to those of the communication device 100 of FIG. 1. Accordingly, the two embodiments can achieve similar levels of performance.

Figure 3B:
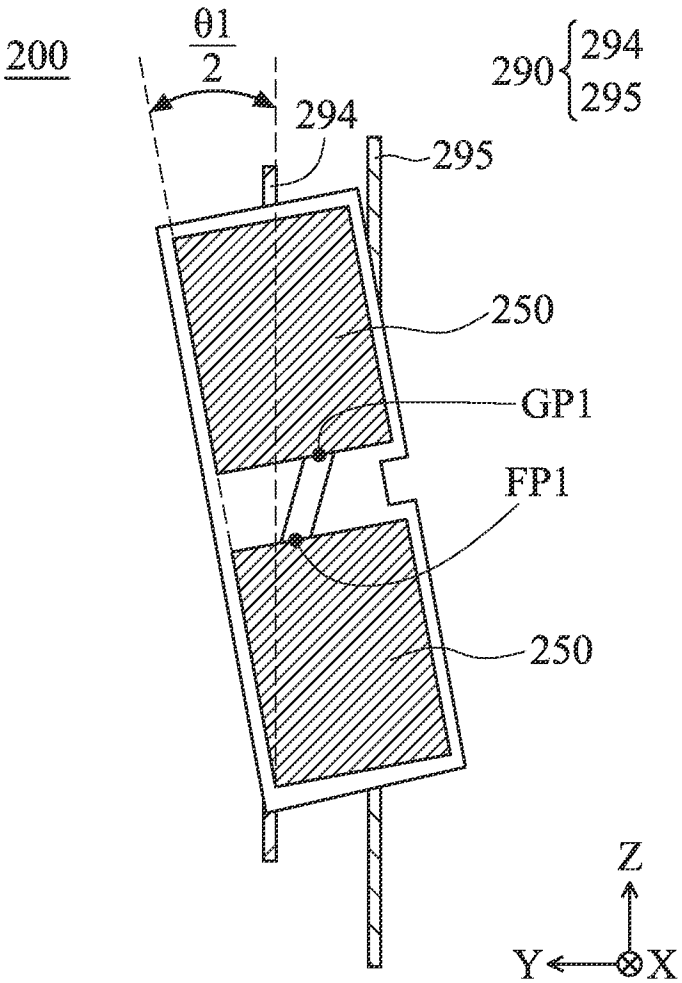
FIG. 3B is a right-side view of a communication device according to an embodiment of the invention.
Figure 3A:
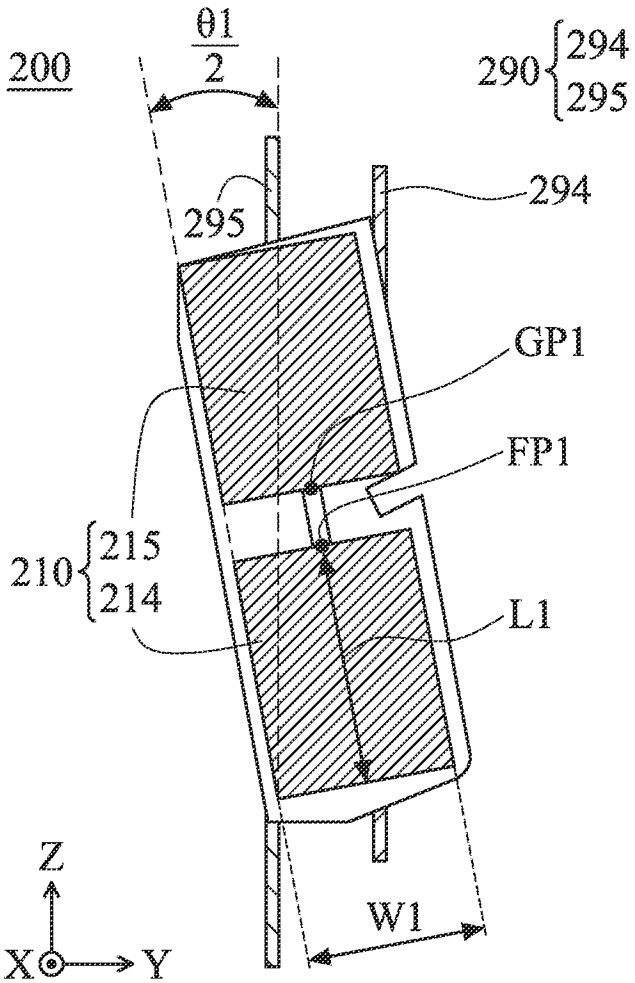
FIG. 3A is a left-side view of a communication device according to an embodiment of the invention.

FIG. 3A is a left-side view of the communication device 200 according to an embodiment of the invention. FIG. 3B is a right-side view of the communication device 200 according to an embodiment of the invention. To simplify the figures, only the first antenna element 210, the fifth antenna element 250, and the PCB 290 are displayed in FIG. 3A and FIG. 3B. In the embodiment of FIG. 3A and FIG. 3B, a first angle θ1 is formed between the first antenna element 210 and the fifth antenna element 250. For example, an angle between the first antenna element 210 and the PCB 290 may be a half of the first angle θ1 (i.e., θ1/2). Also, another angle between the fifth antenna element 250 and the PCB 290 may be a half of the first angle θ1.

Specifically, each of the first antenna element 210 and the fifth antenna element 250 includes a first radiation element 214 and a second radiation element 215, which substantially extend in opposite directions and away from each other. The first radiation element 214 is coupled to a first feeding point FP1, and it may substantially have a relatively long straight-line shape. The second radiation element 215 is coupled to a first grounding point GP1, and it may substantially have another relatively long straight-line shape.

Figure 4A:
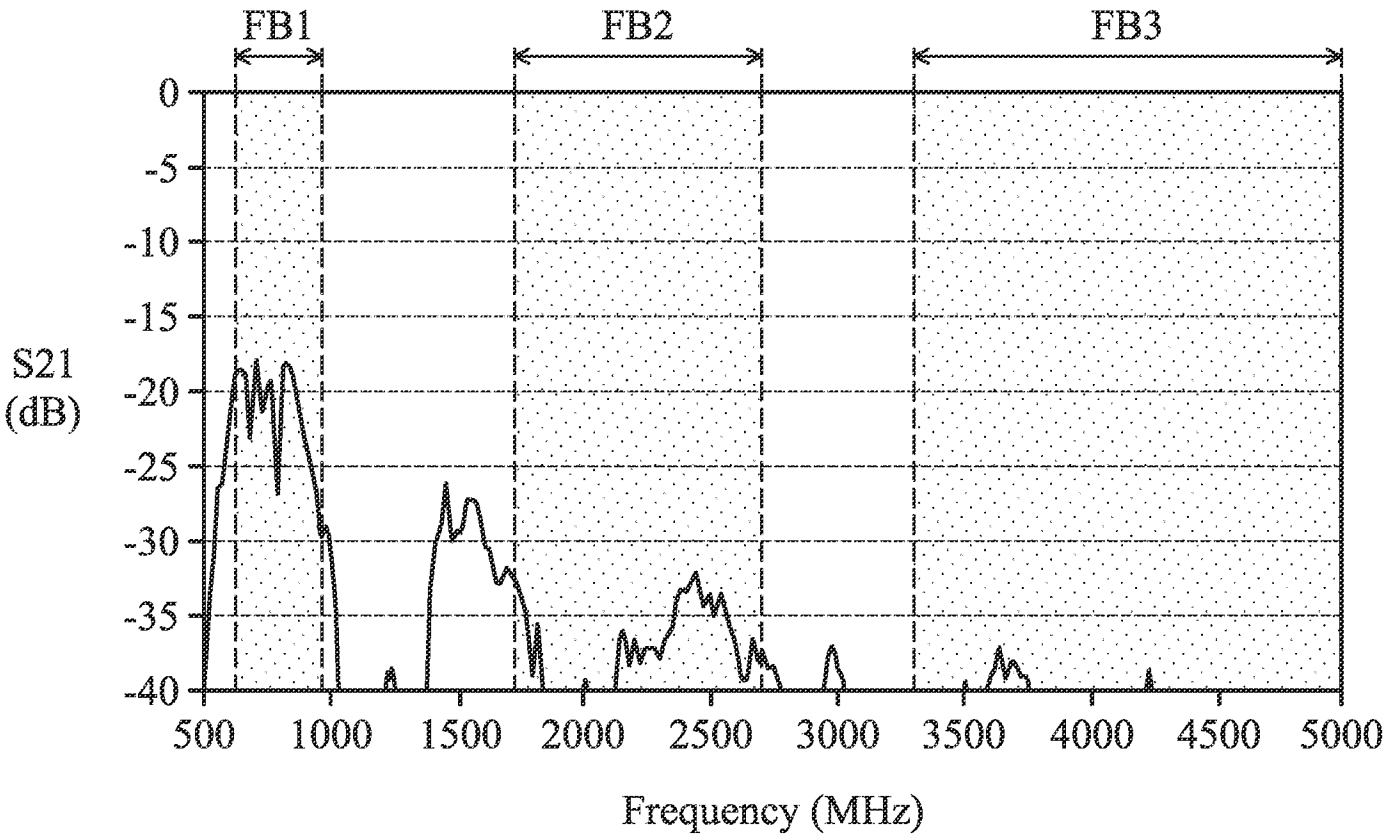
FIG. 4A is a diagram of an S21 parameter when a first antenna element and a fifth antenna element are parallel to each other, according to an embodiment of the invention.
Figure 4B:
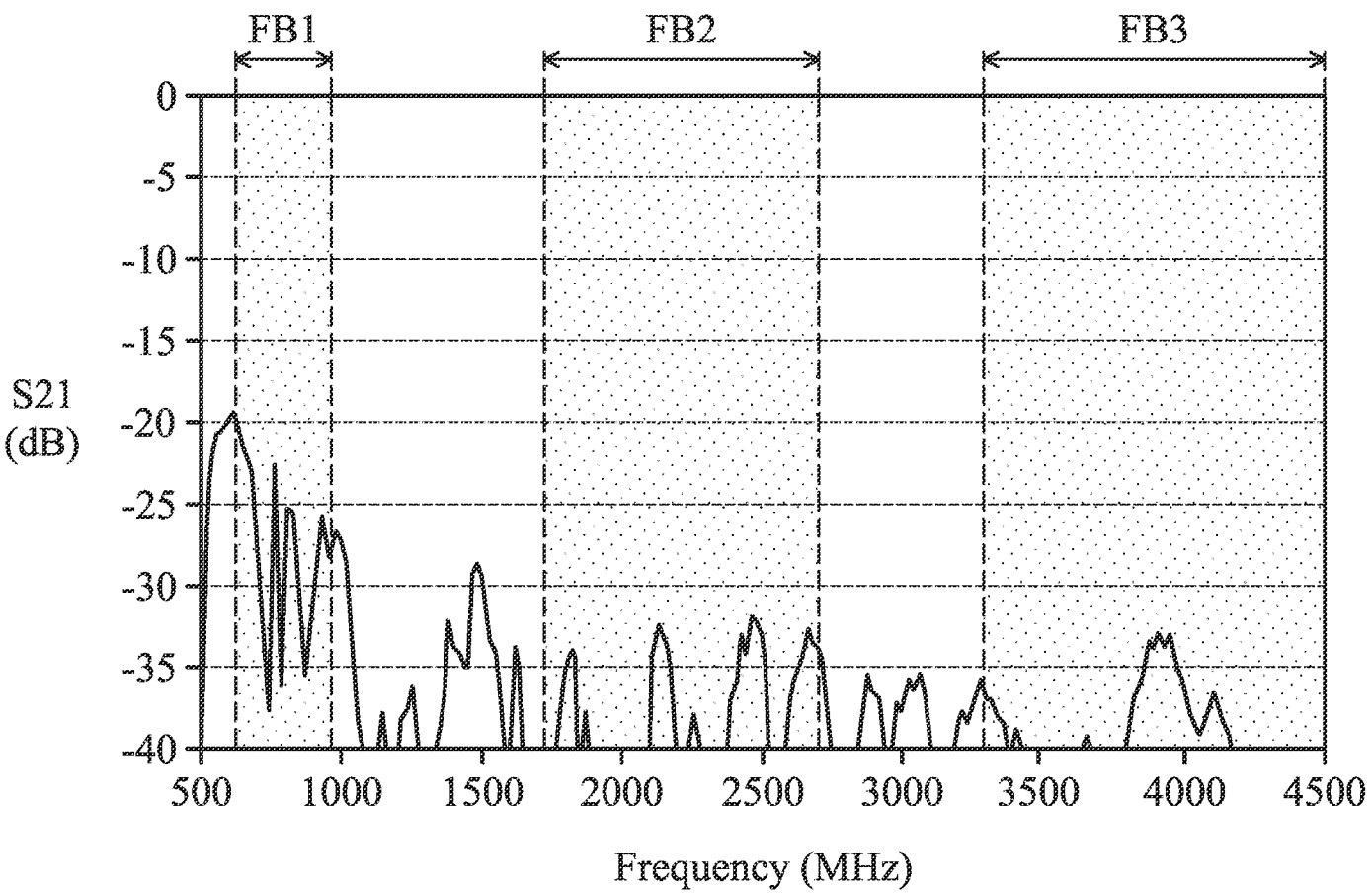
FIG. 4B is a diagram of an S21 parameter when a first antenna element and a fifth antenna element are not parallel to each other, according to an embodiment of the invention.

FIG. 4A is a diagram of the S21 parameter when the first antenna element 210 and the fifth antenna element 250 are parallel to each other (i.e., the first angle θ1 is equal to 0), according to an embodiment of the invention. FIG. 4B is a diagram of the S21 parameter when the first antenna element 210 and the fifth antenna element 250 are not parallel to each other (i.e., the first angle θ1 is not equal to 0), according to an embodiment of the invention. In the embodiment of FIG. 4A and FIG. 4B, the first antenna element 210 is considered as a first port (Port 1), the fifth antenna element 250 is considered as a second port (Port 2). The S21 parameter between the first port and the second port represents the isolation between the first antenna element 210 and the fifth antenna element 250. According to the comparison between FIG. 4A and FIG. 4B, the deflective design of the first antenna element 210 and the fifth antenna element 250 can help to increase the isolation of the communication device 200 by at least about 4 dB within the first frequency band FB1.

Figure 5B:
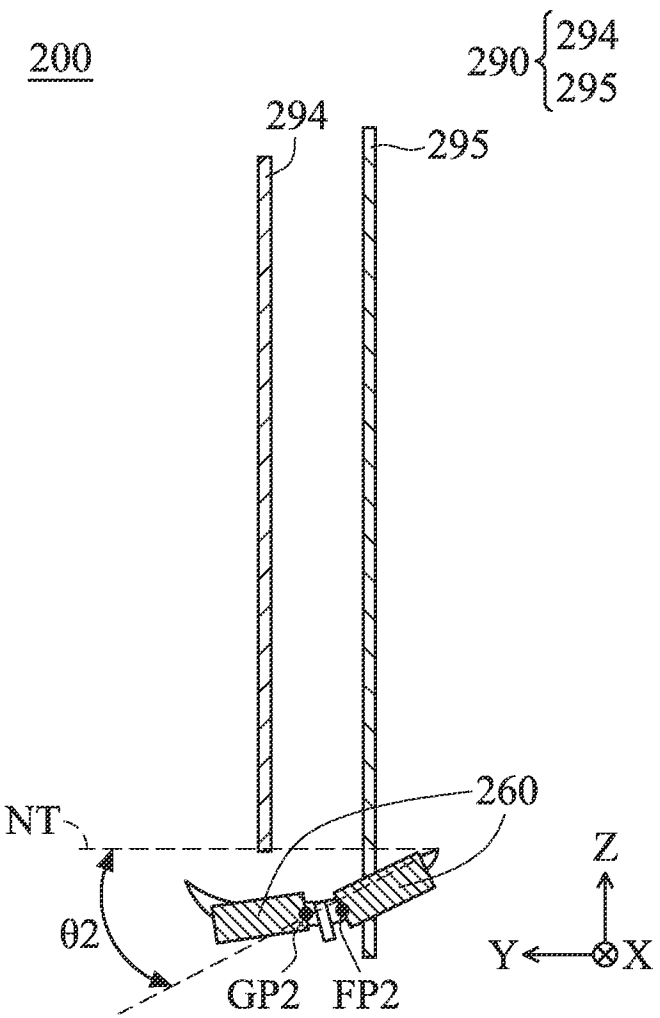
FIG. 5B is a right-side view of a communication device according to an embodiment of the invention.
Figure 5A:
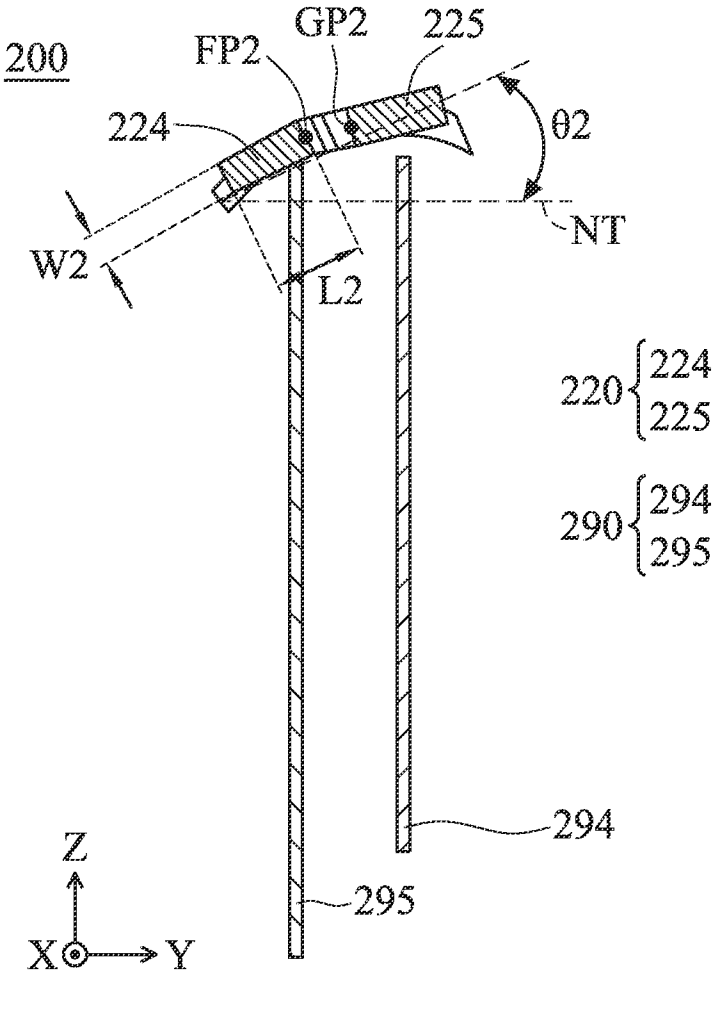
FIG. 5A is a left-side view of a communication device according to an embodiment of the invention.

FIG. 5A is a left-side view of the communication device 200 according to an embodiment of the invention. FIG. 5B is a right-side view of the communication device 200 according to an embodiment of the invention. To simplify the figures, only the second antenna element 220, the sixth antenna element 260, and the PCB 290 are displayed in FIG. 5A and FIG. 5B. In the embodiment of FIG. 5A and FIG. 5B, a second angle θ2 is formed between a normal direction NT of the PCB 290 and each of the second antenna element 220 and the sixth antenna element 260. According to practical measurements, the deflective design of the second antenna element 220 and the sixth antenna element 260 can help to eliminate the nulls of the radiation pattern of the communication device 200 within the second frequency band FB2.

Specifically, each of the second antenna element 220, the sixth antenna element 260, and the seventh antenna element 270 includes a third radiation element 224 and a fourth radiation element 225, which substantially extend in opposite directions and away from each other. The third radiation element 224 is coupled to a second feeding point FP2, and it may substantially have a relatively medium straight-line shape. The fourth radiation element 225 is coupled to a second grounding point GP2, and it may substantially have another relatively medium straight-line shape.

Figure 6B:
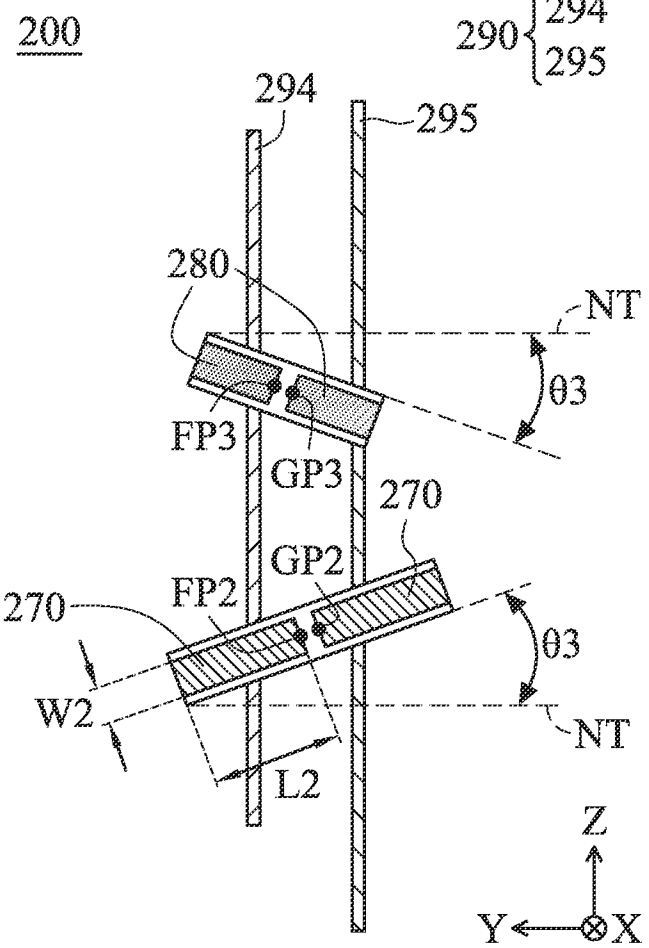
FIG. 6B is a right-side view of a communication device according to an embodiment of the invention.
Figure 6A:
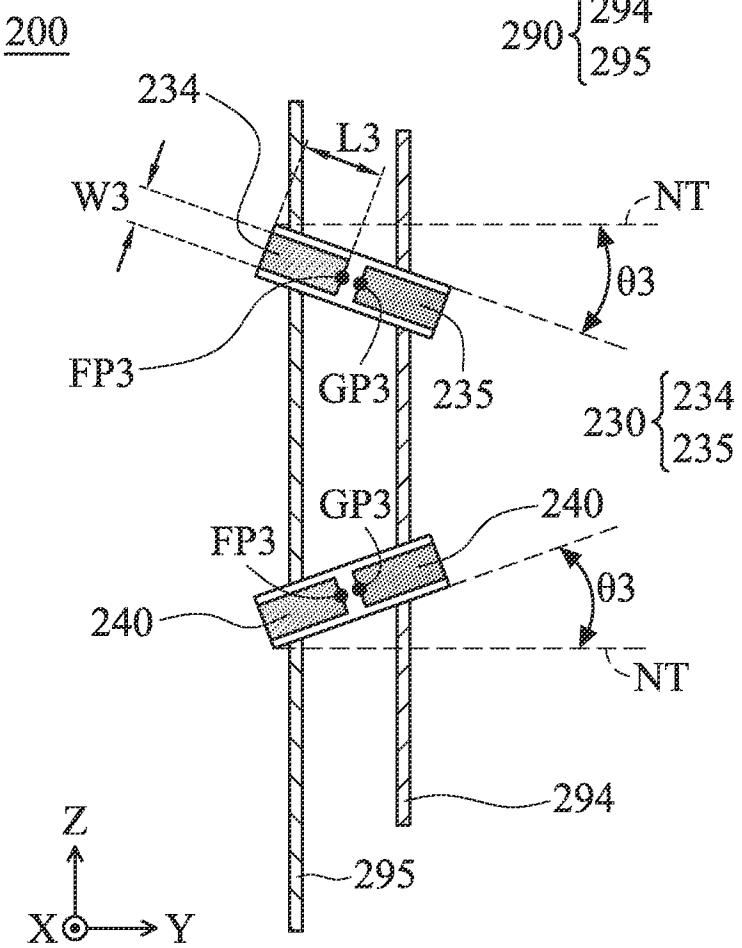
FIG. 6A is a left-side view of a communication device according to an embodiment of the invention.

FIG. 6A is a left-side view of the communication device 200 according to an embodiment of the invention. FIG. 6B is a right-side view of the communication device 200 according to an embodiment of the invention. To simplify the figures, only the third antenna element 230, the fourth antenna element 240, the seventh antenna element 270, the eighth antenna element 280, and the PCB 290 are displayed in FIG. 6A and FIG. 6B. In the embodiment of FIG. 6A and FIG. 6B, a third angle θ3 is formed between the normal direction NT of the PCB 290 and each of the third antenna element 230, the fourth antenna element 240, the seventh antenna element 270, and the eighth antenna element 280. According to practical measurements, the deflective design of the third antenna element 230, the fourth antenna element 240, the seventh antenna element 270, and the eighth antenna element 280 can help to eliminate the nulls of the radiation pattern of the communication device 200 within the third frequency band FB3. As a whole, the first antenna element 210, the second antenna element 220, the third antenna element 230, the fourth antenna element 240, the fifth antenna element 250, the sixth antenna element 260, the seventh antenna element 270, and the eighth antenna element 280 are all deflected with respect to the PCB 290.

Specifically, each of the third antenna element 230, the fourth antenna element 240, and the eighth antenna element 280 includes a fifth radiation element 234 and a sixth radiation element 235, which substantially extend in opposite directions and away from each other. The fifth radiation element 234 is coupled to a third feeding point FP3, and it may substantially have a relatively short straight-line shape. The sixth radiation element 235 is coupled to a third grounding point GP3, and it may substantially have another relatively short straight-line shape.

Figure 7A:
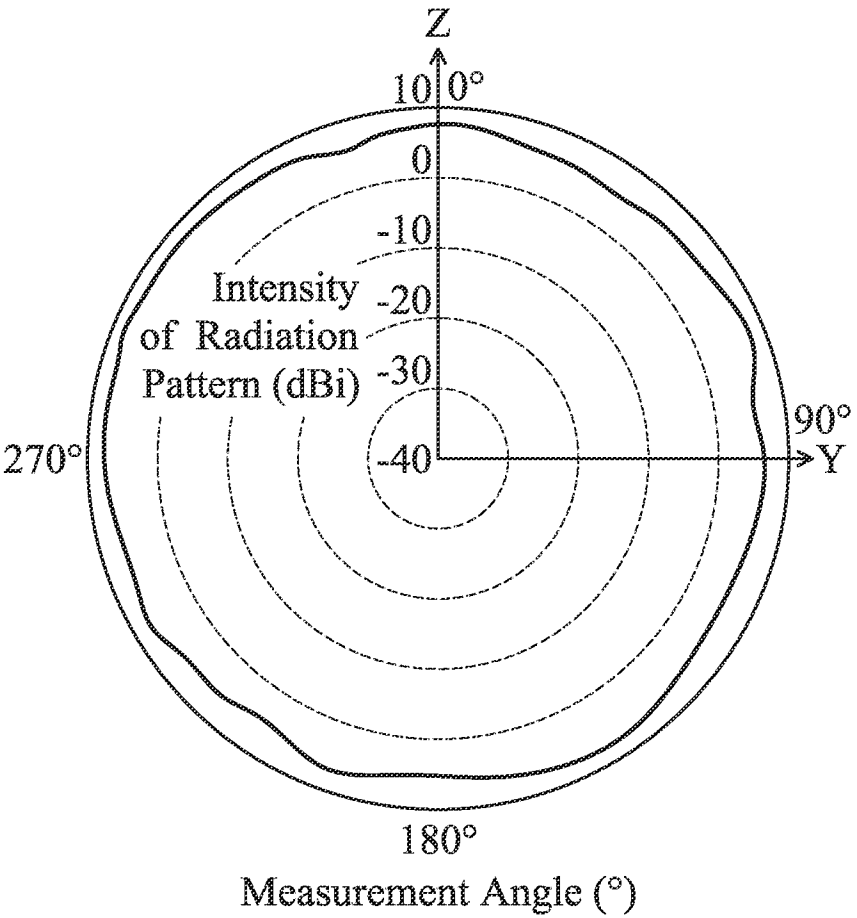
FIG. 7A is a radiation pattern of a communication device measured on one plane according to an embodiment of the invention.
Figure 7B:
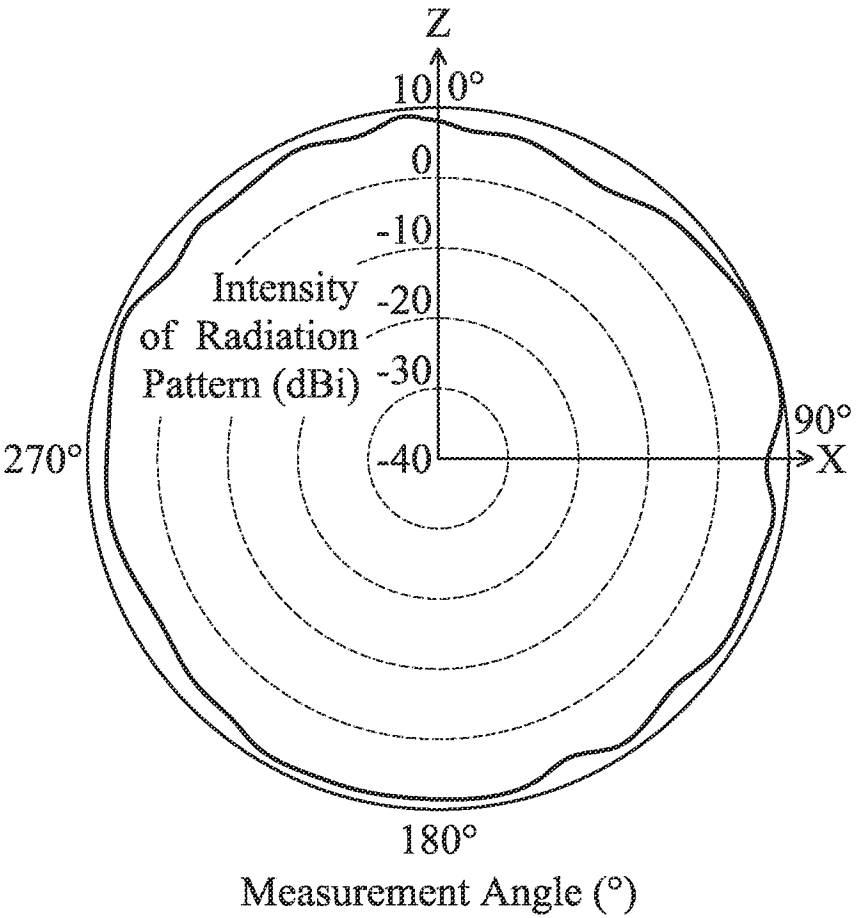
FIG. 7B is a radiation pattern of a communication device measured on another plane according to an embodiment of the invention.
Figure 7C:
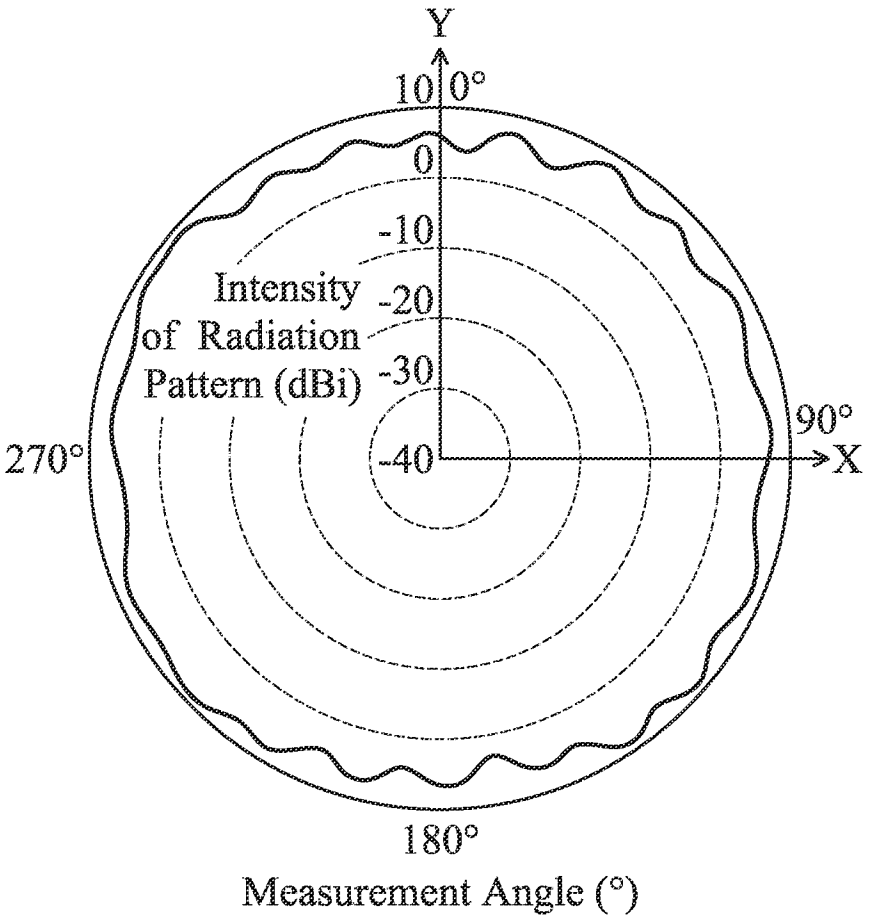
FIG. 7C is a radiation pattern of a communication device measured on the other plane according to an embodiment of the invention.

FIG. 7A is a radiation pattern of the communication device 200 measured on the XZ-plane according to an embodiment of the invention. FIG. 7B is a radiation pattern of the communication device 200 measured on the YZ-plane according to an embodiment of the invention. FIG. 7C is a radiation pattern of the communication device 200 measured on the XY-plane according to an embodiment of the invention. Based on the measurement of FIG. 7A, FIG. 7B and FIG. 7C, within the third frequency band FB3, the communication device 300 can provide an almost omnidirectional radiation pattern, and it can meet the requirements of applications of general mobile communication devices.

In some embodiments, the element sizes of the communication device 200 will be described as follows. The distance D1 between the first antenna element 210 and the first side 291 of the PCB 290 may be longer than or equal to 30 mm. The distance D2 between the fifth antenna element 250 and the second side 292 of the PCB 290 may be longer than or equal to 30 mm. The length L1 of each of the first radiation element 214 and the second radiation element 215 may be substantially equal to 0.25 wavelength ($\lambda/4$) of the first frequency band FB1. The width W1 of each of the first radiation element 214 and the second radiation element 215 may be from 32 mm to 48 mm, such as about 40 mm. The length L2 of each of the third radiation element 224 and the fourth radiation element 225 may be substantially equal to 0.25 wavelength ($\lambda/4$) of the second frequency band FB2. The width W2 of each of the third radiation element 224 and the fourth radiation element 225 may be from 8 mm to 12 mm, such as about 10 mm. The length L3 of each of the fifth radiation element 234 and the sixth radiation element 235 may be substantially equal to 0.25 wavelength ($\lambda/4$) of the third frequency band FB3. The width W3 of each of the fifth radiation element 234 and the sixth radiation element 235 may be from 8 mm to 12 mm, such as about 10 mm. The first angle $\theta 1$ may be from 10 to 30 degrees. The second angle $\theta 2$ may be from 15 to 25 degrees. The third angle $\theta 3$ may be from 15 to 25 degrees. The above ranges of element sizes are calculated and obtained according to many experiment results, and they help to optimize the isolation, the omni-directivity, the operational bandwidth, and the impedance matching of the communication device 200.

The invention proposes a novel communication device, which includes a plurality of antenna elements integrated with a PCB. In comparison to the conventional design, the invention has at least the advantages of high isolation and almost omni-directivity. Therefore, the invention is suitable for application in a variety of devices.

Note that the above element sizes, element shapes, and frequency ranges are not limitations of the invention. A designer can fine-tune these settings or values according to different requirements. It should be understood that the communication device of the invention is not limited to the configurations of FIGS. 1-7. The invention may merely include any one or more features of any one or more embodiments of FIGS. 1-7. In other words, not all of the features displayed in the figures should be implemented in the communication device of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A communication device, comprising:
a first antenna element;
a second antenna element;
a third antenna element;
a fourth antenna element;
a fifth antenna element;
a sixth antenna element;
a seventh antenna element;
an eighth antenna element; and
a PCB (Printed Circuit Board), having a first side and a second side opposite to each other;
wherein at least one of the first antenna element, the second antenna element, the third antenna element, the fourth antenna element, the fifth antenna element, the sixth antenna element, the seventh antenna element, and the eighth antenna element is adjacent to the first side of the PCB;
wherein the other(s) of the first antenna element, the second antenna element, the third antenna element, the fourth antenna element, the fifth antenna element, the sixth antenna element, the seventh antenna element, and the eighth antenna element is/are adjacent to the second side of the PCB;
wherein a first angle is formed between the first antenna element and the fifth antenna element, and the first angle is from 10 to 30 degrees; or
wherein a second angle is formed between a normal direction of the PCB and each of the second antenna element and the sixth antenna element, and the second angle is from 15 to 25 degrees; or
wherein a third angle is formed between a normal direction of the PCB and each of the third antenna element, the fourth antenna element, the seventh antenna element, and the eighth antenna element, and the third angle is from 15 to 25 degrees.

2. The communication device as claimed in claim 1, wherein the communication device provides an almost omnidirectional radiation pattern.

3. The communication device as claimed in claim 1, wherein the first antenna element, the second antenna element, the third antenna element, and the fourth antenna element are adjacent to the first side of the PCB, and wherein the fifth antenna element, the sixth antenna element, the seventh antenna element, and the eighth antenna element are adjacent to the second side of the PCB.

4. The communication device as claimed in claim 1, wherein at least one of the third antenna element and the fourth antenna element is positioned between the first antenna element and the first side of the PCB.

5. The communication device as claimed in claim 1, wherein each of the first antenna element, the second antenna element, the third antenna element, the fourth antenna element, the fifth antenna element, the sixth antenna element, the seventh antenna element, and the eighth antenna element is a dipole antenna.

6. The communication device as claimed in claim 1, wherein the communication device covers a first frequency band, a second frequency band, and a third frequency band.

7. The communication device as claimed in claim 6, wherein the first antenna element and the fifth antenna element are excited to generate the first frequency band, the second frequency band, and the third frequency band.

8. The communication device as claimed in claim 6, wherein the second antenna element, the sixth antenna element, and the seventh antenna element are excited to generate the second frequency band and the third frequency band.

9. The communication device as claimed in claim 6, wherein the third antenna element, the fourth antenna element, and the eighth antenna element are excited to generate the third frequency band.

10. The communication device as claimed in claim 1, wherein the first antenna element, the second antenna element, the third antenna element, the fourth antenna element, the fifth antenna element, the sixth antenna element, the seventh antenna element, and the eighth antenna element are all deflected with respect to the PCB.

11. The communication device as claimed in claim 6, wherein each of the first antenna element and the fifth antenna element comprises:

a first radiation element, coupled to a first feeding point; and a second radiation element, coupled to a first grounding point, wherein the second radiation element and the first radiation element substantially extend in opposite directions.

12. The communication device as claimed in claim 11, wherein a length of each of the first radiation element and the second radiation element is substantially equal to 0.25 wavelength of the first frequency band.

13. The communication device as claimed in claim 6, wherein each of the second antenna element, the sixth antenna element, and the seventh antenna element comprises:

a third radiation element, coupled to a second feeding point; and a fourth radiation element, coupled to a second grounding point, wherein the fourth radiation element and the third radiation element substantially extend in opposite directions.

14. The communication device as claimed in claim 13, wherein a length of each of the third radiation element and the fourth radiation element is substantially equal to 0.25 wavelength of the second frequency band.

15. The communication device as claimed in claim 6, wherein each of the third antenna element, the fourth antenna element, and the eighth antenna element comprises:

a fifth radiation element, coupled to a third feeding point; and a sixth radiation element, coupled to a third grounding point, wherein the sixth radiation element and the fifth radiation element substantially extend in opposite directions.

16. The communication device as claimed in claim 15, wherein a length of each of the fifth radiation element and the sixth radiation element is substantially equal to 0.25 wavelength of the third frequency band.

17. The communication device as claimed in claim 1, wherein the PCB comprises a first layer board and a second layer board parallel to each other.

* * * * *